US006357421B1

(12) United States Patent
Pritchard

(10) Patent No.: US 6,357,421 B1
(45) Date of Patent: Mar. 19, 2002

(54) COMMON RAIL FUEL SYSTEM

(75) Inventor: Christopher S. Pritchard, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/618,995

(22) Filed: Jul. 18, 2000

(51) Int. Cl.[7] ..... F02M 37/04
(52) U.S. Cl. ..... 123/456; 123/508; 123/446
(58) Field of Search ..... 123/456, 509, 123/457, 446, 467, 508

(56) References Cited

U.S. PATENT DOCUMENTS

| | | | | |
|---|---|---|---|---|
| 3,990,422 A | | 11/1976 | Watson et al. | |
| 4,068,640 A | | 1/1978 | Watson et al. | |
| 4,412,513 A | * | 11/1983 | Obermayer et al. | 123/54.4 |
| 5,035,221 A | | 7/1991 | Martin | |
| 5,109,822 A | | 5/1992 | Martin | |
| 5,133,645 A | | 7/1992 | Crowley et al. | |
| 5,201,294 A | | 4/1993 | Osuka | |
| 5,230,613 A | | 7/1993 | Hilsbos et al. | |
| 5,277,156 A | | 1/1994 | Osuka et al. | |
| 5,311,850 A | | 5/1994 | Martin | |
| 5,339,786 A | | 8/1994 | Martin | |
| 5,419,298 A | * | 5/1995 | Nolte et al. | 123/508 |
| 5,456,233 A | * | 10/1995 | Felhofer | 123/447 |
| 5,605,134 A | | 2/1997 | Martin | |
| 5,638,791 A | | 6/1997 | Tsuzuki et al. | |
| 6,016,791 A | | 1/2000 | Thomas et al. | |
| 6,138,641 A | * | 10/2000 | Moser | 123/456 |

* cited by examiner

*Primary Examiner*—Thomas N. Moulis
(74) *Attorney, Agent, or Firm*—Brooks & Kushman P.C.

(57) ABSTRACT

A common rail diesel fuel injection system that uses as many as one high-pressure engine-cam-driven fuel pump per engine cylinder, each of the high-pressure engine-cam-driven fuel pumps being driven directly by the engine cam. The system includes a common rail to receive the outputs of the high-pressure engine-cam-driven fuel pumps to maintain a high and uniform fuel pressure. The system also includes a fuel transfer pump to supply relatively low-pressure fuel to the high-pressure engine-cam-driven fuel pumps. Fuel from the common rail is distributed to solenoid-controlled fuel injectors. The latter have outputs connected to respective pressure regulator valves to regulate fuel pressure and to provide a path, in additional to the injection path, through which fuel flows to reduce injector temperature. An embodiment is included wherein a programmable logic device controls fuel injectors in response to selected engine operation sensor inputs. A further embodiment places the fuel transfer pump under control of the programmable logic device to minimize excess fuel transfer pump operation.

18 Claims, 4 Drawing Sheets

10
62
64
27
26
28
52
60
42
32
40
30
24
22
12
44
66
74
54
34
46
14
68
56
36
48
16
70
58
38
50
29
18
72

COMMON RAIL FUEL SYSTEM

TECHNICAL FIELD

This invention relates generally to fuel injection systems for diesel engines and, in particular, to common rail diesel engine applications.

BACKGROUND ART

Direct diesel fuel injection systems use high-pressure fuel pumps to build up pressure for each injection cycle. Injection pressures of these systems are generally dependent on speed and fuel output. At relatively low engine speeds and fuel outputs, injection pressure falls off, producing a less-than-optimum fuel injection process for good combustion.

Common rail fuel injection systems maintain a constant pressure. They typically include high-pressure fuel pumps, driven by a cam separate from an engine cam, that force fuel into an accumulator, or common rail. Fuel from the common rail is fed through solenoid-controlled valves to selected injectors in individual engine cylinders. With this type of system, compression and injection are independent. The rate of fuel injection into the cylinders is a function the fuel pressure within the common rail; therefore, the rate of fuel injection may be effectively controlled by controlling the common rail fuel pressure.

Fuel transfer pumps are used to transfer fuel from a source to the high-pressure fuel pumps. Fuel transfer pump output control is typically limited to pressure regulator valves, and the work demanded of the transfer pumps is often in excess of what is necessary.

DISCLOSURE OF INVENTION

The common rail fuel injection system of the present invention includes a plurality of high-pressure, engine-cam-driven fuel pumps. Each pump has a fuel input port and a fuel output port. A common rail having a plurality of fuel input ports and a plurality of fuel output ports is also included, each of the engine-cam-driven fuel pump output ports being connected to a respective common rail fuel input port. A plurality of solenoid-controlled fuel injectors, each having a fuel input port, are also connected to the common rail, each common rail output port being connected to a respective fuel injector input port. A fuel transfer pump is connected between a source of fuel and each of the fuel input ports of the engine-cam-driven fuel pumps to supply fuel to the engine-cam-driven fuel pumps.

The fuel injection system also includes a plurality of pressure regulator valves. Each is connected to a respective fuel injector to limit the maximum fuel pressure within the fuel injector and to provide a path, in additional to the injection path, through which fuel flows to reduce injector temperature

BRIEF DESCRIPTION OF DRAWINGS

A more complete appreciation of the invention and many of the attendant advantages thereof may be readily obtained by reference to the following detailed description when considered with the accompanying drawings in which like reference characters indicate corresponding parts in all the views, wherein.

BEST MODE FOR CARRYING OUT THE INVENTION

Figure 1:
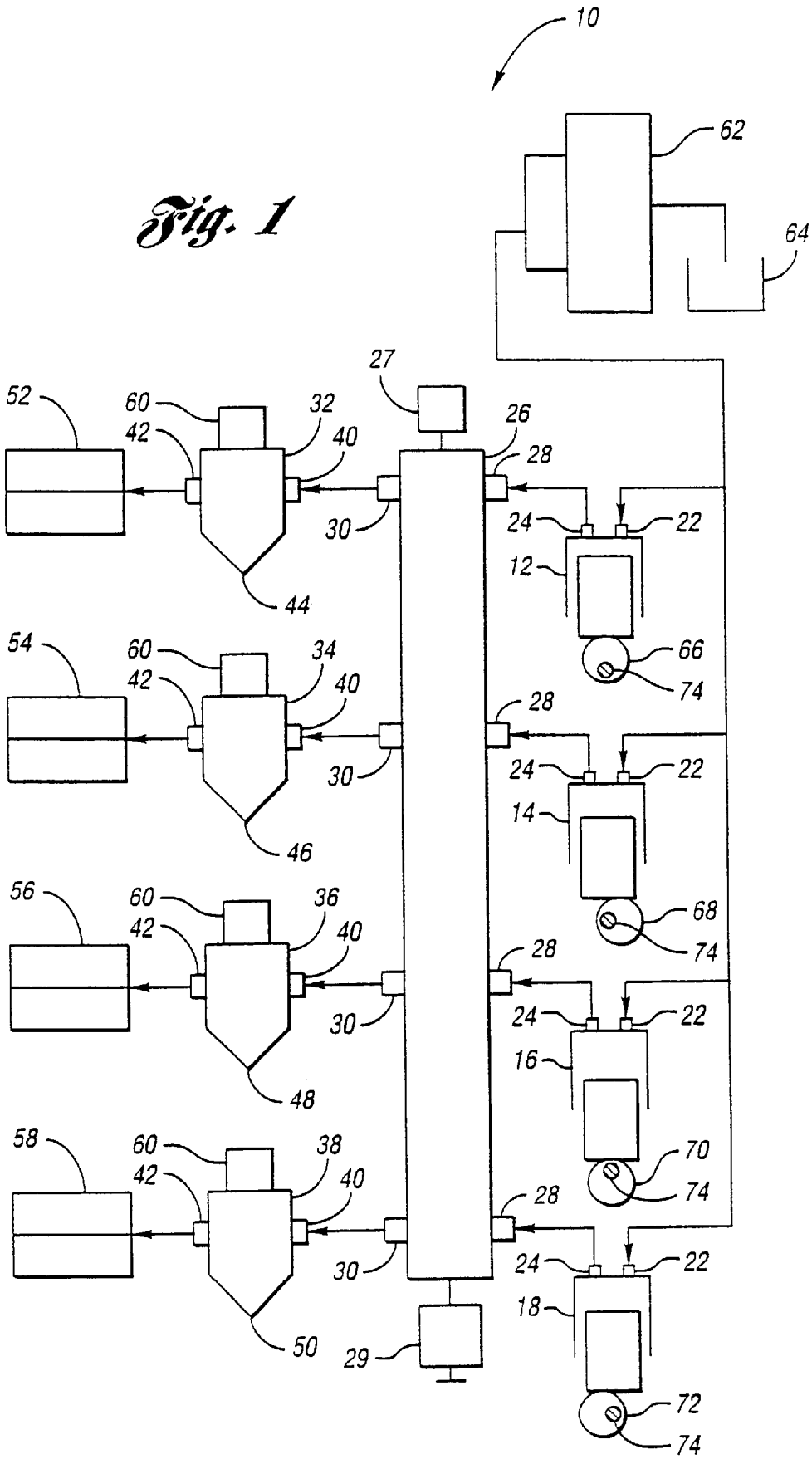
FIG. 1 is a schematic view illustrating a first embodiment of a common rail fuel injection system of the present invention.

FIG. 1 of the drawing represents a first embodiment of a common rail fuel injection system, generally indicated by the reference numeral 10, for a vehicle. For the sake of convenience, the figure shows a fuel injection system for a four-cylinder diesel engine (not shown); but it should be noted that the invention could just as well be applied to engines having a different number of cylinders. It should also be noted that, depending on the design and operating characteristics of a specific engine, there need not always be as many engine-cam-driven fuel pumps as there are engine cylinders. FIG. 1 shows four high-pressure engine-cam-driven fuel pumps 12, 14, 16 and 18. The pump design is based on the design of the pump portion of a unit fuel injector, and each of these engine-cam-driven fuel pumps has a fuel input port 22 and a fuel output port 24.

Also shown is a common rail, or an accumulator, 26 having the same number of fuel input ports 28 as there are engine-cam-driven fuel pumps 12, 14, 16 and 18. It should be understood by those skilled in the art, however, that the common rail 26 could have a different number of fuel input ports 28 without departing from the scope and spirit of the present invention. Each of the engine-cam-driven fuel pump output ports 24 are connected to a respective one of the common rail input ports 28. The common rail 26 also has connected to it a rail fuel pressure sensor 27 that generates a rail fuel pressure signal representative of the common rail fuel pressure. The common rail 26 also has connected thereto a rail fuel pressure regulator valve 29 to limit maximum common rail fuel pressure. The fuel injection system further includes a number of fuel injectors 32, 34, 36 and 38, one for each engine cylinder; and each fuel injector has a fuel input port 40, a fuel output port 42 and an injector nozzle 44, 46, 48 and 50 respectively. The fuel injector design is based on the design of a unit fuel injector. The latter is an assembly that receives fuel under supply pressure and is then actuated by an engine mechanism such as a driven cam to meter and inject a charge of fuel to a combustion chamber at high pressure in a timely manner.

The common rail 26 shown has a number of fuel output ports 30 equal to the number of fuel injectors 32, 34, 36 and 38, and each of the fuel output ports 30 is connected to a respective fuel injector fuel input port 40. It should be understood by those skilled in the art, however, that the common rail 26 could have a different number of fuel output ports 28 without departing from the scope and spirit of the present invention. A pressure regulator valve 52, 54, 56 and 58 is shown connected to each of the respective fuel injector outputs 42. Again, it should be understood by those skilled in the art that pressure regulators could be connected to the fuel injector outputs 42 in a manner other than in a direct, one-to-one relationship without departing from the scope and spirit of the present invention. Each fuel injector 32, 34, 36 and 38 is controlled by a solenoid 60. The pressure regulator valves 52, 54, 56 and 58 limit the maximum fuel pressure within the respective fuel injectors 32, 34, 36 and 38 and provide paths, in addition to those through the injector nozzles 44, 46, 48 and 50, through which fuel flows to reduce injector temperatures.

A fuel transfer pump 62 draws fuel from a representative source 64. The fuel transfer pump 62 is connected to the fuel input ports 22 of the engine-cam-driven fuel pumps 12, 14, 16 and 18 to provide fuel under relatively low-pressure to these high-pressure pumps. As shown, each of these fuel pumps 12, 14, 16 and 18 is driven by a respective engine cam 66, 68, 70 or 72. These cams are located on and driven by an engine camshaft 74 and have lobes whose eccentricities are sequentially and angularly displaced by an angle equal to 360 degrees divided by the number of engine-cam-driven fuel pumps they drive. In the system shown, the lobes are sequentially and angularly displaced by 90 degrees so that each of the four engine-cam-driven pumps pressurizes the common rail 26 during every complete revolution of the camshaft 74. In a six-cylinder engine (not shown) having six engine-cam-driven fuel pumps, the cam lobes would be sequentially and angularly displaced by 60 degrees. Those skilled in the art should recognize that other configurations with different angular displacements without departing from the scope and spirit of the present invention.

By using a plurality of high-pressure engine-cam-driven fuel pumps 12, 14, 16 and 18 rather than just one, the fuel pressure in the common rail 26 is more constant and its average level is higher. By driving each high-pressure engine-cam-driven fuel pump 12, 14, 16 and 18 directly by the engine cam 66, an additional, separate cam, with its attendant manufacturing and assembly expenses and friction losses, is not needed.

Figure 2:
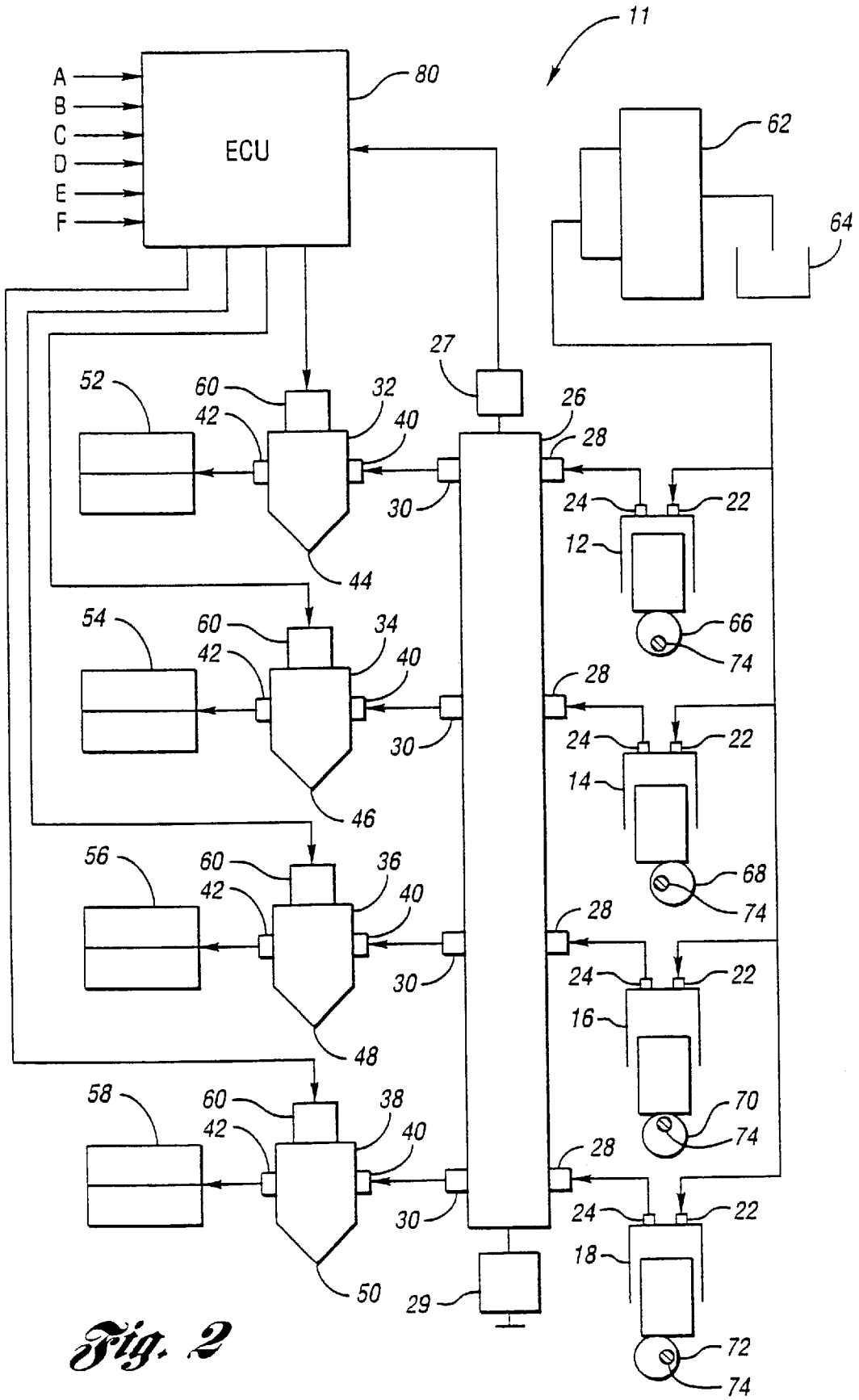
FIG. 2 is a schematic view similar to that of FIG. 1 but illustrating a second embodiment by virtue of an added electronic control unit.

FIG. 2 of the drawing represents a second embodiment of a common rail fuel injection system 11. It is similar to the first embodiment shown in FIG. 1, but it also includes an electronic control unit (ECU) 80 having a plurality of input connections A, B, C, D, E and F for receiving electrical vehicle operating condition sensor signals. The ECU 80 also receives the rail fuel pressure signal from the rail fuel pressure sensor 27, and it typically includes a programmable logic device for generating fuel injection control signals as a function of the received sensor signals.

The solenoids 60 that control the individual fuel injectors 32, 34, 36 and 38 are directed by the control signals generated by the (ECU) 80, which is electrically connected to each solenoid 60. A rail fuel pressure signal is also communicated to the ECU 80 from the rail fuel pressure sensor 27. The inputs A, B, C, D, E and F can be individually tailored for different engines and conditions. Representative inputs typically include the following:

A—crankshaft position (as a timing reference),

B—throttle position (as a load reference),

C—turbo boost,

D—oil pressure

E—oil temperature, and

F—coolant level.

Figure 3:
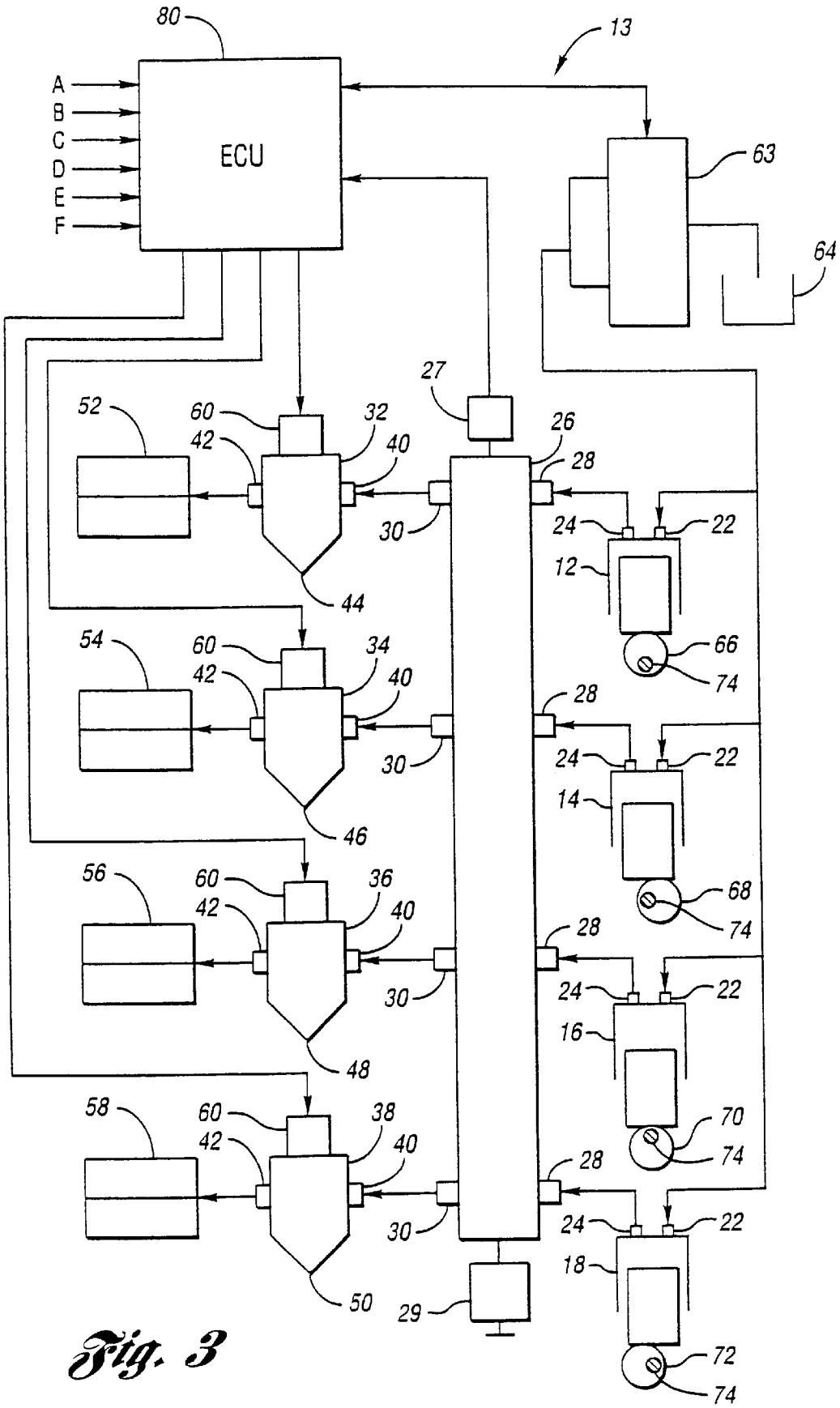
FIG. 3 is a schematic view similar to that of FIG. 2 but illustrating a third embodiment by virtue of an added connection between the electronic control unit and a fuel transfer pump.

FIG. 3 of the drawing represents a third embodiment of a common rail fuel injection system 13. It is similar to the second embodiment shown in FIG. 2, but the fuel transfer pump 63 is an electronically controlled pump that is electrically connected to the electronic control unit 80 so that the latter can regulate the supply of fuel to the engine-cam-driven pumps and thereby limit excess fuel transfer pump operation and reduce component wear and wasted energy.

Figure 4:
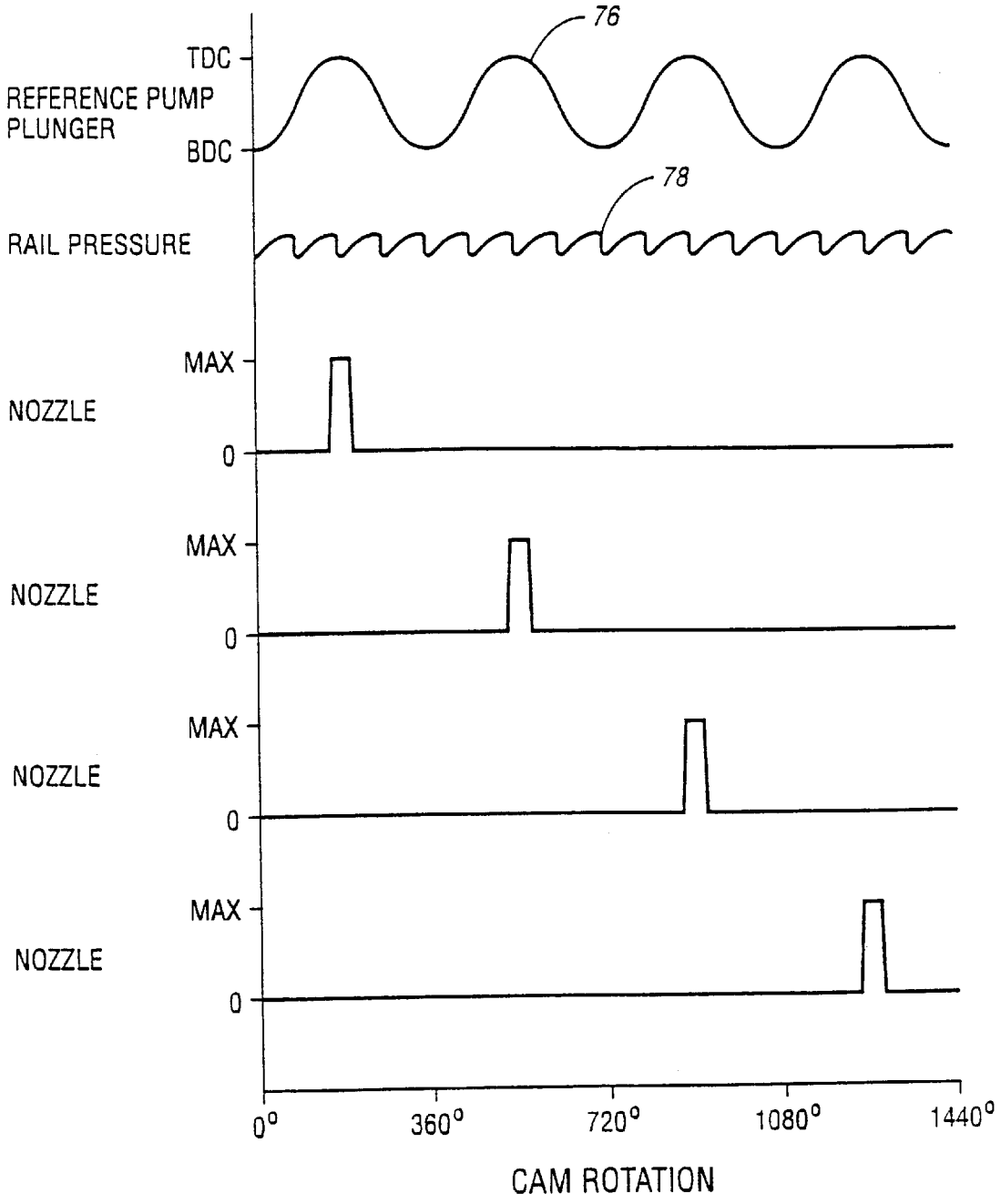
FIG. 4 is a graphical representation showing relative fuel pressures within the common rail and at the fuel injector nozzles with respect to cam rotation.

FIG. 4 illustrates the relationships of the position of an arbitrary engine-cam-driven fuel pump plunger and rail pressure with respect to engine-cam rotation. As shown, the pump plunger position 76 varies with engine-cam rotation in a cyclic manner. Since four engine-cam-driven fuel pumps 12, 14, 16 and 18 cycle during one cam rotation, rail pressure 78 is maintained at a higher and more constant level than if the pressure was being maintained by only one engine-cam-driven fuel pump. Fuel pressure at each fuel injector nozzle 44, 46, 48 and 50 is also shown as a function of engine-cam rotation.

While embodiments of the invention have been illustrated and described, it is not intended that these embodiments illustrate and describe all possible forms of the invention. Rather, the words used in the specification are words of description rather than limitation, and it is to be understood that various changes may be made without departing from the spirit and scope of the invention.

What is claimed is:

1. A common rail fuel injection system, comprising:

a plurality of high-pressure, engine-cam-driven fuel pumps, each having a fuel input port and a fuel output port;

a common rail having a plurality of fuel input ports and a plurality of fuel output ports, each of the engine-cam-driven fuel pump output ports being connected to a respective common rail fuel input port;

a plurality of solenoid-controlled fuel injectors each having a fuel input port connected to a respective common rail fuel output port; and a fuel transfer pump connected between a source of fuel and each of the fuel input ports of the engine-cam-driven fuel pumps to supply fuel to the engine-cam-driven fuel pumps.

2. The common rail fuel injection system as defined by claim 1, further including a rail pressure regulator valve connected to the common rail to regulate the maximum fuel pressure therein.

3. The common rail fuel injection system as defined by claim 2, further including a rail pressure sensor connected to the common rail to generate an output signal representative of the fuel pressure therein.

4. The common rail fuel injection system as defined by claim 3, further including a plurality of pressure regulator valves each connected to a respective fuel injector to limit the maximum fuel pressure within the fuel injector and to provide a path, in additional to the injection path, through which fuel flows to reduce injector temperature.

5. The common rail fuel injector system as defined by claim 4, further including a check valve operatively connected to the input fuel port of each engine-cam-driven fuel pump to prohibit fuel from flowing from the engine-cam-driven fuel pump toward the fuel transfer pump.

6. The common rail fuel injector system as defined by claim 5, further including a check valve operatively connected to the output fuel port of each engine-cam-driven engine-cam-driven fuel pump to prohibit fuel from flowing from the common rail toward the engine-cam-driven fuel pump.

7. A common rail fuel injection system, comprising:

a plurality of high-pressure, engine-cam-driven fuel pumps, each having a fuel input port and a fuel output port;

a common rail having a plurality of fuel input ports and a plurality of fuel output ports, each of the engine-cam-driven fuel pump output ports being connected to a respective common rail fuel input port;

a plurality of solenoid-controlled fuel injectors each having a fuel input port connected to a respective common rail fuel output port;

a fuel transfer pump connected between a source of fuel and each of the fuel input ports of the engine-cam-driven fuel pumps to supply fuel to the engine-cam-driven fuel pumps; and an electronic control unit having a plurality of input connections for receiving electrical vehicle operating condition sensor signals, having a programmable logic device for generating output signals as a function of the received sensor signals, the output signals being communicated to respective solenoid-controlled fuel injectors to control fuel injector operation.

8. The common rail fuel injection system as defined by claim 7, further including a rail pressure regulator valve connected to the common rail to regulate the maximum fuel pressure therein.

9. The common rail fuel injection system as defined by claim 8, further including a rail pressure sensor connected to the common rail to generate an output signal representative of the fuel pressure therein, the signal being communicated to the electronic control unit.

10. The common rail fuel injection system as defined by claim 9, further including a plurality of pressure regulator valves each connected to a respective fuel injector to limit the maximum fuel pressure within the fuel injector and to provide a path, in additional to the injection path, through which fuel flows to reduce injector temperature.

11. The common rail fuel injector system as defined by claim 10, further including a check valve operatively connected to the input fuel port of each engine-cam-driven fuel pump to prohibit fuel from flowing from the engine-cam-driven fuel pump toward the fuel transfer pump.

12. The common rail fuel injector system as defined by claim 11, further including a check valve operatively connected to the output fuel port of each engine-cam-driven fuel pump to prohibit fuel from flowing from the common rail toward the engine-cam-driven fuel pump.

13. A common rail fuel injection system, comprising:

a plurality of high-pressure, engine-cam-driven fuel pumps, each having a fuel input port and a fuel output port;

a common rail having a plurality of fuel input ports and a plurality of fuel output ports, each of the engine-cam-driven fuel pump output ports being connected to a respective common rail fuel input port;

a plurality of solenoid-controlled fuel injectors each having a fuel input port connected to a respective common rail fuel output port;

an electronic control unit having a plurality of input connections for receiving electrical vehicle operating condition sensor signals, having a programmable logic device for generating output signals as a function of the received sensor signals, the output signals being communicated to respective solenoid-controlled fuel injectors to control fuel injector operation; and an electronically controlled fuel transfer pump connected between a source of fuel and each of the fuel input ports of the engine-cam-driven fuel pumps, the electronic control unit being electrically connected to the fuel transfer pump to regulate the flow of fuel supplied to the engine-cam-driven fuel pumps and limit excess transfer pump operation.

14. The common rail fuel injection system as defined by claim 13, further including a rail pressure regulator valve connected to the common rail to regulate the maximum fuel pressure therein.

15. The common rail fuel injection system as defined by claim 14, further including a rail pressure sensor connected to the common rail to generate an output signal representative of the fuel pressure therein, the signal being communicated to the electronic control unit.

16. The common rail fuel injection system as defined by claim 15, further including a plurality of pressure regulator valves each connected to a respective fuel injector to limit the maximum fuel pressure within the fuel injector and to provide a path, in additional to the injection path, through which fuel flows to reduce injector temperature.

17. The common rail fuel injector system as defined by claim 16, further including a check valve operatively connected to the input fuel port of each engine-cam-driven fuel pump to prohibit fuel from flowing from the engine-cam-driven fuel pump toward the fuel transfer pump.

18. The common rail fuel injector system as defined by claim 17, further including a check valve operatively connected to the output fuel port of each engine-cam-driven fuel pump to prohibit fuel from flowing from the common rail toward the engine-cam-driven fuel pump.

* * * * *